United States Patent [19]

Marten

[11] Patent Number: 4,640,551

[45] Date of Patent: Feb. 3, 1987

[54] ROCK SAW UNIT FOR HARD ROCK EARTH FORMATIONS

[76] Inventor: Edward N. Marten, P.O. Box 183, Von Ormy, Tex. 79703

[21] Appl. No.: 779,148

[22] Filed: Sep. 23, 1985

Related U.S. Application Data

[63] Continuation-in-part of Ser. No. 614,460, May 25, 1984, which is a continuation-in-part of Ser. No. 103,231, Dec. 13, 1979, Pat. No. 4,542,940, which is a continuation-in-part of Ser. No. 966,338, Dec. 4, 1978, Pat. No. 4,230,372.

[51] Int. Cl.[4] ..... E21C 27/10

[52] U.S. Cl. ..... 299/1; 299/37; 299/38; 299/69

[58] Field of Search ..... 299/14, 37, 38, 39, 299/60, 70

[56] References Cited

U.S. PATENT DOCUMENTS

| | | | |
|---|---|---|---|
| 1,858,360 | 5/1932 | Cruse . | |
| 3,222,876 | 12/1965 | Harmstorf | 61/72.4 |
| 3,550,961 | 12/1970 | Hughes | 299/71 |
| 3,827,507 | 8/1974 | Lance | 173/15 |
| 3,922,017 | 11/1975 | Cobb | 299/37 X |
| 4,069,605 | 1/1978 | Satterwhite | 299/39 |
| 4,126,083 | 11/1978 | Haak et al. | 299/37 X |
| 4,230,372 | 10/1980 | Marten | 299/39 |
| 4,542,940 | 9/1985 | Marten | 299/1 |

FOREIGN PATENT DOCUMENTS 7520922 1/1977 France .

*Primary Examiner*—Stephen J. Novosad
*Assistant Examiner*—Thomas J. Odar
*Attorney, Agent, or Firm*—Hubbard, Thurman, Turner & Tucker

[57] ABSTRACT

Hard rock trenching apparatus comprised of a pair of spaced apart diamond toothed cutting blades mounted for rotation in combination with a hydraulically operated breakout tool having a chisel face supported behind the cutting blades in a plane located intervening within the spacing between the cutting blades. The tool is continuously operable for removing the center core remaining between the blades while an adjustable linkage enables positioning the chisel of the tool at or above the cutting plane of the blades.

14 Claims, 7 Drawing Figures

ROCK SAW UNIT FOR HARD ROCK EARTH FORMATIONS

This application is a continuation-in-part of application Ser. No. 614,460 filed May 25, 1984 which in turn is a continuation-in-part of co-pending U.S. patent application Ser. No. 103,231, Dec. 13, 1979 now U.S. Pat. No. 4,542,940 which is in turn a continuation-in-part of application Ser. No. 966,338 filed Dec. 4, 1978 and now U.S. Pat. No. 4,230,372.

TECHNICAL FIELD

The field of art to which the invention pertains includes the art of machinery for disintegrating hard material.

BACKGROUND OF THE INVENTION

Earth trenching machines for digging vertical wall trenches are well known as exemplified by U.S. Pat No. 4,230,372, and as disclosed in the parent application incorporated herein by reference. Typically, such equipment utilizes a rock saw unit having spaced apart saw wheels suitably supported for rotation from the end of an elongated boom contained on a crawler or track-type vehicle. Controls and adjustments provided on the vehicle enable the angle and depth of saw cut to be adjustably preset to accommodate immediate trenching needs.

As disclosed in the parent application hereof, saw wheels typically utilized for earth trenching include carbide cutting teeth and effectively produce parallel spaced apart side cuts leaving a center portion between cuts that is subsequently removed by means of a side chisel, explosive and/or crumbing shoe. All such equipment is known to operate well through relatively soft soil formations such a sand or even limestone, but have generally been inefficient and unsuitable for trenching through granite or other igneous hard rock. Not only must the hard rock be sawed through, but the problem is compounded by need to remove the center rock remaining between saw cuts. This has posed difficulty in the trade in that the need arises with some degree of frequency for trenching through such hard rock formations.

One instance where this has been encounted with particular concern is in long continuous trenching for long distance laying of fiberoptic cable. Customary trenching dimensions for cable laying are usually about four-four and one half inches in width to a depth of about twelve-eighteen inches. It is obviously preferred to be able to trench continuously without interruption, yet where a hard rock formation has been encountered using conventional saw units both delay and interruption have been incurred because of equipment failure. Despite recognition of the problem, suitable equipment for those purpose has not heretofore been known.

SUMMARY OF THE INVENTION

This invention relates to rock saw trenching apparatus and more specifically, to such apparatus adapted for efficient trenching through hard rock formation. This is achieved in accordance with the invention utilizing a rotary driven rock saw unit having spaced apart diamond toothed cutting blades. Operably combined with the cutter is a hydraulically operated breakaway tool supported behind the cutting blades at a location corresponding to the spacing intervening between the cutting blades. By means of an extendable hydraulic piston connected to pivotal linkage supporting the breakaway tool, adjustable positioning setting of the tool face can be effected at any desired height relative to the cutting plane of the blades. The entire unit is adapted to be supported from the elongated boom of a crawler or tractor type vehicle.

It is, therefore, an object of the invention to provide a novel rock saw trenching unit suitable for trenching through exceedingly hard rock formations.

It is a further object of the invention to effect the foregoing object in a highly efficient and economical manner as compared to prior art apparatus previously utilized therefor.

BRIEF DESCRIPTION OF THE DRAWINGS

Referring now to FIG. 1, there is illustrated a rock saw trenching unit designated 10 in accordance with the invention as will be described. The rock saw unit may for example be generally supported and utilized in a manner disclosed in co-pending U.S. application Ser. No. 614,460 filed May 25, 1984, entitled "Rotary Rock and Trenching Cutting Saw". As therein disclosed, saw unit 10 is supported on a support head 12 which is mounted on the end of an elongated boom 14 in turn supported on a self propelled track or crawler type vehicle designated 16. Vehicle 16 typically of a type which may b adapted for use as an excavating apparatus known in the art as a backhoe.

Figure 1:
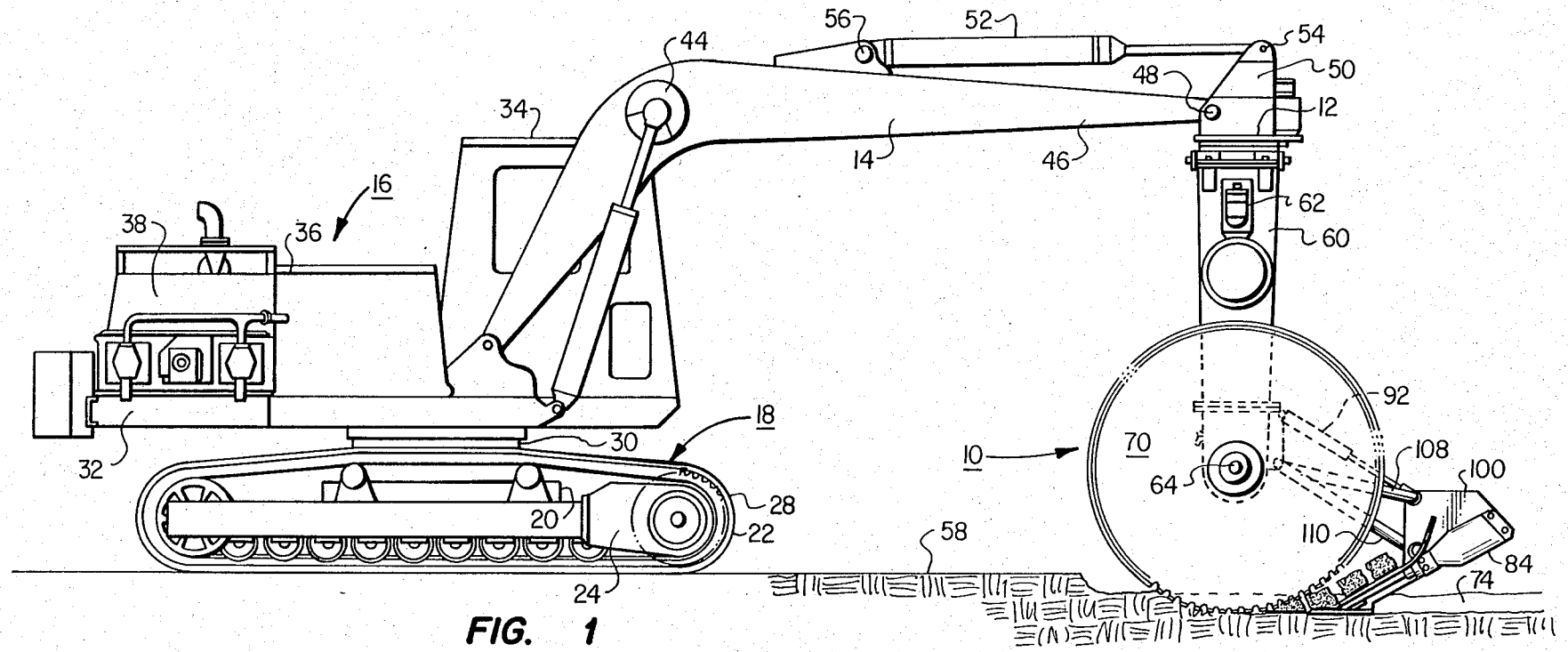
FIG. 1 is a side elevation of a trench and rock cutting saw apparatus of the present invention mounted on a self propelled track type undercarriage and support boom.

Vehicle 16 is comprised of an undercarriage 18 having a frame 20 and propulsion wheels comprising a pair of spaced apart endless crawler tracks 22. The tracks are each driven by a hydraulic motor powered track drive unit 24 comprising a positive displacement hydraulic motor (not shown) driving a track drive sprocket 28 through suitable reduction gearing.

Frame 20 includes a conventional, generally cylindrical bearing structure 30 adapted to support a platform 32 for rotary movement about a vertical axis with respect to tracks 22. Platform 32 contains an operator's cab 34 supported thereon and an enclosure 36 for housing a prime mover such as a diesel engine 38 driving one or more hydraulic pumps as is well known in the art. Platform 32 also supports boom 14 at a pivot connection 40 for pivotal movement about a horizontal axis. For vertical displacement boom 14 is supported with respect to the platform 32 by actuator means comprising dual hydraulic cylinder and piston assemblies 42 connected at one end to the platform 32 and at the opposite to boom 14 at pivot connections 44.

To enable pivoting of head and saw unit 10 generally about a horizontal zxis, the distal end 46 supports a pivot pin 48 extending between spaced apart support brackets 50 forming a pivotal connection between the boom and head 12. An elongated hydraulic cylinder and piston type actuator 52 is connected to the boom 14 and to the bracket 50 pivot connections 54 and 56. In this arrangement, rotary saw unit 10 may be raised and lowered with respect to the earth's surface 58 by actuation of the cylinder actuator 42 and may be pivoted about the horizontal axis via actuation of the cylinder actuator 52. Additional controls (not shown) may be likewise contained in and about vehicle 16 for further positioning saw unit 10 as required.

Trenching unit 10, as will now be described with reference to the remaining figures, is supported from head 12 by means of a vertically oriented frame structure 60. Supported on frame 60 is a positive displacement hydraulic motor 62 connected to a suitable gear train for driving laterally emerging output shaft 64. Secured to shaft 64 for rotation therewith via a plurality of bolts 68 and cap ring 69 is a drive hub 66 on which spaced apart cutting blades 70 are mounted. Supported intervening between the blades is a lateral spacer 72 of selected width dimension as appropriate for producing the desired width "X" of an earth trench 74.

Figure 7:
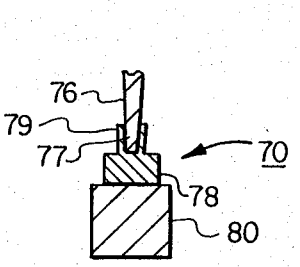
FIG. 7 is a sectional view taken substantially along the lines 7—7 of FIG. 5.
Figure 6:
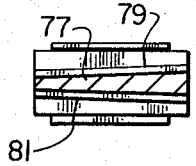
FIG. 6 is a plan view of the saw unit cutting teeth mount.
Figure 5:
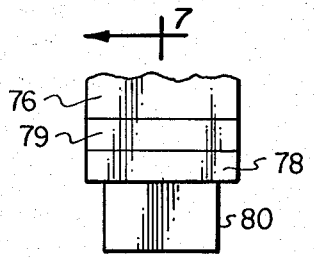
FIG. 5 is a side elevation of the saw unit cutting teeth mount.
Figure 4:
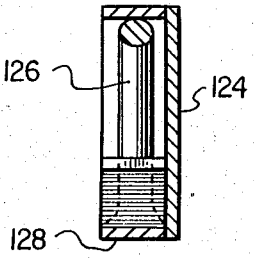
FIG. 4 is a sectional view taken substantially along the lines 4—4 of FIG. 2.
Figure 3:
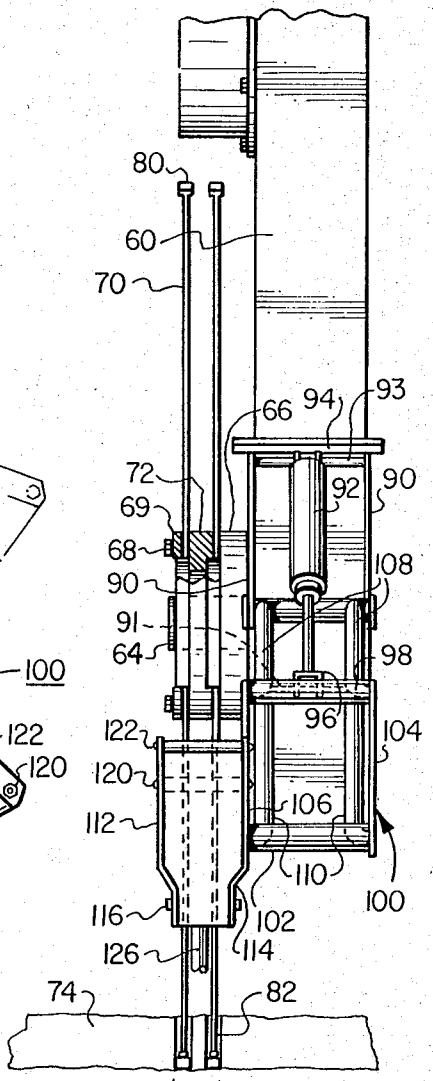
FIG. 3 is a front elevation of FIG. 2.

As best seen in FIGS. 5–7, blades 70, in accordance herewith, are comprised of a steel center disc 76 which at its circumference includes a plurality of peripherally tapered tooth tips 77. Forming a shoe for mounting thereon is a steel flange 78 containing a secured block of teeth 80 comprised of diamond or other composition of comparable cutting hardness and durability. Along the top surface 79 of flange 78 there is defined a groove 81 for receiving an individual tooth tip 77 in a wedged interfit therewith.

Forming part of trenching unit 10 for removing the hard rock center portion 82 remaining between the kerfs cut by blades 70, is a breakout tool 84. In the preferred embodiment tool 82 comprises a hydraulically powered demolition tool of a type described in U.S. Pat. No. 3,827,507 incorporated herein by reference. Hydraulic lines 86 and 88 supply the operating fluid to tool 84 as more fully disclosed in the patent.

For supporting breakout tool 84, there is secured to frame 60 a pair of vertically extending support brackets 90 containing pivotal cross pins 91 and 93. Connected to pin is a pair of elongated spaced apart support arms 108 and a pair of elongated spaced apart support arms 110. Connected to pin 93 via clevis 94 is a hydraulic lift cylinder 92. Oppositely connected to the arms 108 and 110 and to cylinder 92 via a clevis 96 is a frame 100 that includes lower cross bracing 102 and side plates 104 and 106 bolted together as a unit.

Figure 2:
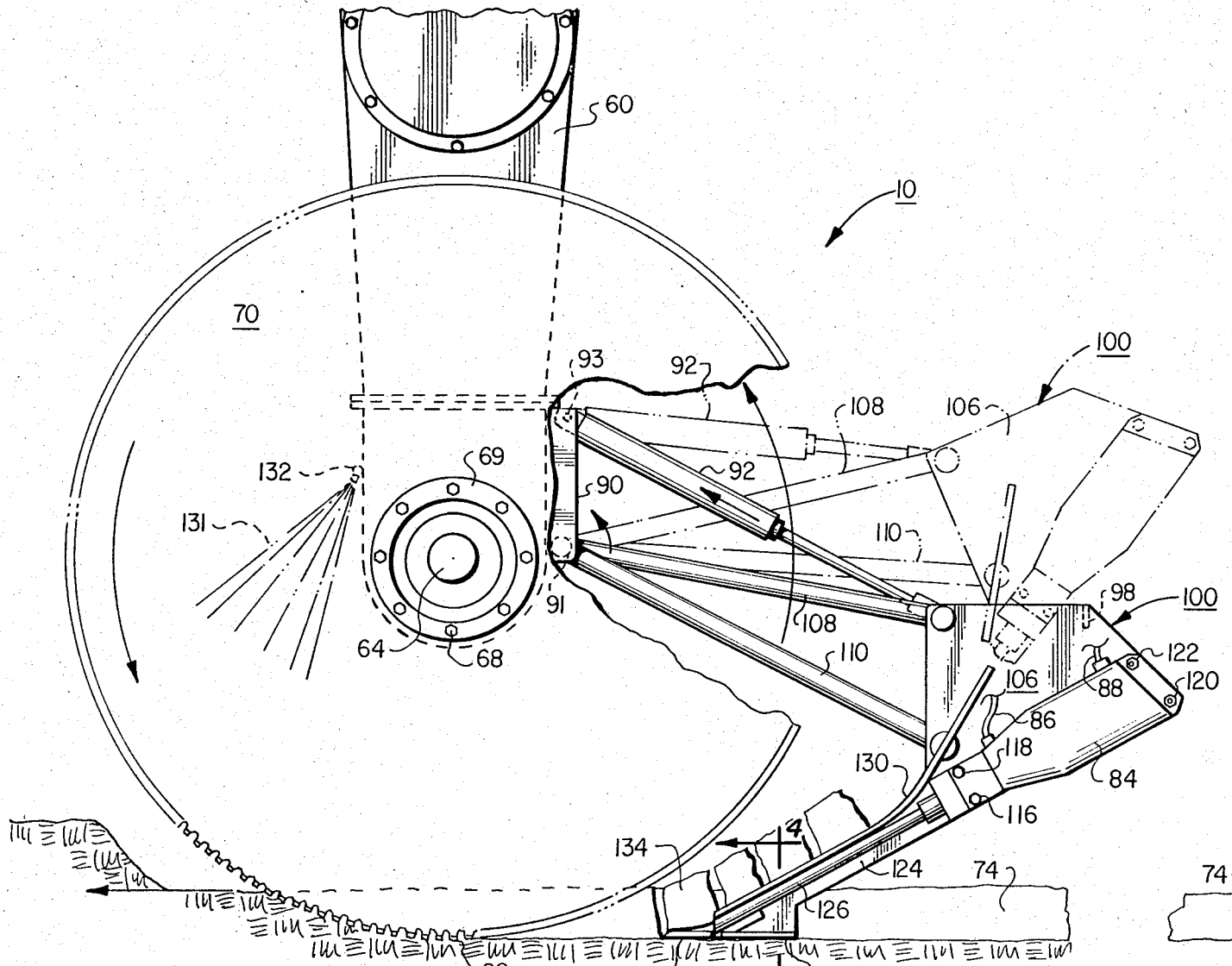
FIG. 2 is an enlarged side elevation of the trench and rock cutting saw unit of FIG. 1.

Tool 84 is per se braced between tie plates 112 and 114 secured together via bolts 116 and 118 for mounting on frame 100 by means of bolts 120 and 122. Also supported from brackets 112 and 114 is a side plate 124 having a bottom flange 128 enclosing chisel tool 126 that terminates at its lower end in a horizontally shown chisel face 127. By actuating hydraulic cylinder 92, the vertical positioning of breakout tool 84 and its end face 127 can be adjustably set as required between the position shown solid to the position shown in phantom in FIG. 2. In this arrangement chisel face 127 when in its lowered position is maintained in a vertical plane corresponding to the location of rock center portion 82 to be removed. Horizontally, tool 84 should be positioned sufficiently displaced behind the cutters 80 to enable broken rock particles 134 to clear the cutters as the particles are removed upwardly on crumbing shoe 130.

A water spray can 131 optionally be provided from nozzle 132 to enhance cutting action of the saw unit when required.

In operation for trenching through granite or other igneous hard rock, the chisel end face 127 of breakout tool 84 is positioned via hydraulic cylinder 92 to lie in a horizontal plane substantially coincident with the cutting plane of diamond teeth 80 on rotating cutting blades 70. Advancing vehicle 16 causes kerfs to be formed by the cutting action of the blades to an overall trence width "X". Since breakout tool 84 is of a type described for responding to encountered loading imposed by center rock portion 82 against chisel end face 127, the tool will automatically continue with a chiseling action for breaking out the rock particles 134 so long as such loading is encountered. Concomitantly therewith, crumbing shoe 130 will lift broken rock particles 134 up and away from tool 84.

By the above description there is disclosed novel rock saw trenching apparatus as specifically adapted for cutting through extremely hard formations such as granite or other igneous type rock. Unlike previous saw apparatus constructions utilized for such purposes, cutting speeds on the order of 7,000 to 8,000 feet per minute can be readily maintained without the breakdown or wearout associated with tools of the prior art. When not required, breakout tool 84 can be readily phased out of position, can be used selectively when such formations are encountered or can be used on a continuous basis for whatever formations are anticipated. Therefore, by the novelty of this construction there is provided an efficient and ready solution to the long standing problems associated with hard rock trenching.

Since many changes counl be made in the above construction and many apparently widely different embodiments of this invention could be made without departing from the scope thereof, it is intended that all matter contained in the drawings and specification shall be interpreted as illustrative and not in a limiting sense.

I claim:

1. Rotary trenching apparatus comprising:

an off highway type vehicle operably movable over ground terrain;

an elongated boom extending from said vehicle and adjustable for varying the position setting of its distal end in relative orientation to the ground surface therat;

a support head on the distal end of said boom; and a trenching unit mounted on said support head in a driving relation therewith, and comprising:

a. a pair of axially spaced cutting wheels mounted for rotation in said driving relation and having cutting teeth circumferentially spaced about its periphery;

b. a hydraulically powered breakout tool having a reciprocally actuated chisel face operable for chiseled breakup removal of earth formations encountered against said chisel face;

c. support means for supporting said breakout tool with the chisel face longitudinally spaced from said cutting wheels and in a plane located intervening within the spacing between said cutting wheels; and d. adjustment means to position set the height of said chisel face relative to the cutting plane of said cutting wheels.

2. Rotary trenching apparatus according to claim 1 in which said cutting teeth are of a composition having diamond like hardness.

3. Rotary trenching apparatus in accordance with claim 1 in which said support means comprises a plate on which said breakout tool is mounted and elongated support arms connecting said plate to said support head.

4. Rotary trenching apparatus according to claim 3 in which said support arms are pivotally connected to both said plate and said support head and said adjustment means is operable to controllably pivot said support arms for varying the position setting of said chisel face.

5. Rotary trenching apparatus according to claim 4 in which said adjustment means comprises an extendable hydraulic cylinder connected between said plate and said support head and effective when increasingly extended to lower the vertical plane of said chisel face and effective when increasingly retracted to raise the vertical plane of said chisel face.

6. Rotary trenching apparatus in according to claim 5 including a crumbing shoe secured extending above said chisel face for directing chisel cuttings away from said breakout tool.

7. Rotary trenching apparatus according to claim 5 in which said cutting teeth comprise a plurality of individual sections of cutting teeth circumferentially spaced about the periphery of said wheels and secured to said cutting wheel by a wedged interfit therewith.

8. Rotary trenching apparatus comprising:

a pair of axially separated cutting wheels adapted for rotation and having toothed cutters circumferentially spaced about its periphery;

a hydraulically powered breakout tool having a reciprocally actuated chisel face operable for chiseling removal of earth formations encountered against said chisel face;

support means for supporting said breakout tool with the chisel face longitudinally spaced from said cutting wheels and in a plane intervening within the spacing between said cutting wheels;

adjustment means to position set the height of said chisel face relative to the cutting plane of said cutting wheels; and means for mounting said cutting wheels and said breakout tool onto a vehicle for advancing the cutting wheels and tool through an earth formation to be trenched.

9. Rotary trenching apparatus according to claim 8 in which said cutting teeth are of a composition having diamond like hardness.

10. Rotary trenching apparatus according to claim 8 in which said support means comprises a plate on which said breakout tool is mounted and elongated support arms connecting said plate to said mounting means.

11. Rotary trenching apparatus according to claim 10 in which said support arms are pivotally connected to both said plate and said mounting means and said adjustment means is operable to controllably pivot said support arms for varying the position setting of said chisel face.

12. Rotary trenching apparatus according to claim 11 in which said adjustment means comprises an extendable hydraulic cylinder connected between said plate and said mounting means and effective when increasingly extended to lower the vertical plane of said chisel face and effective when increasingly retracted to raise the vertical plane of said chisel face.

13. Rotary trenching apparatus in according to claim 12 including a crumbing shoe secured extending above said chisel face for directing chisel cuttings away from said breakout tool.

14. Rotary trenching apparatus according to claim 12 in which said teeth comprise a plurality of individual sections of cutting teeth circumferentially spaced about the periphery of said wheels and secured to said cutting wheel by a wedged interfit therewith.

* * * * *